US010334367B2

(12) United States Patent
Tanaka

(10) Patent No.: US 10,334,367 B2
(45) Date of Patent: Jun. 25, 2019

(54) ELECTROACOUSTIC TRANSDUCER

(71) Applicant: Kenta Tanaka, Fujisawa (JP)

(72) Inventor: Kenta Tanaka, Fujisawa (JP)

(73) Assignee: TOKYO ONKYO CO., LTD., Tokyo (JP)

( * ) Notice: Subject to any disclaimer, the term of this patent is extended or adjusted under 35 U.S.C. 154(b) by 0 days.

(21) Appl. No.: 15/564,970

(22) PCT Filed: Apr. 21, 2015

(86) PCT No.: PCT/JP2015/062090
§ 371 (c)(1),
(2) Date: Oct. 6, 2017

(87) PCT Pub. No.: WO2016/170595
PCT Pub. Date: Oct. 27, 2016

(65) Prior Publication Data

US 2018/0098155 A1 Apr. 5, 2018

(51) Int. Cl.
*H04R 7/06* (2006.01)
*H04R 9/04* (2006.01)
(Continued)

(52) U.S. Cl.
CPC ..... *H04R 9/045* (2013.01); *H04R 7/06* (2013.01); *H04R 9/04* (2013.01); *H04R 9/046* (2013.01);
(Continued)

(58) Field of Classification Search
CPC . H04R 1/06; H04R 7/06; H04R 7/127; H04R 9/02; H04R 9/04; H04R 9/045;
(Continued)

(56) References Cited

U.S. PATENT DOCUMENTS 7,499,555 B1 * 3/2009 Isvan ..... H04R 1/1075 381/182
2002/0094097 A1 7/2002 Sagren
(Continued)

FOREIGN PATENT DOCUMENTS

CN 1698399 A 11/2005
CN 101883308 A 11/2010
(Continued)

OTHER PUBLICATIONS

International Preliminary Report on Patentability (Form PCT/IB/326) issued in counterpart International Application No. PCT/JP2015/062090 dated Nov. 2, 2017, with PCT/IB/373, PCT/ISA/237 (10 pages).
(Continued)

*Primary Examiner* — Joshua Kaufman
(74) *Attorney, Agent, or Firm* — Westerman, Hattori, Daniels & Adrian, LLP

(57) ABSTRACT

There is provided an electroacoustic transducer capable of reproducing high-quality sound particularly in a low frequency range, including: a cylindrical yoke; a drive magnet placed coaxially with the yoke so as to circumferentially face the yoke; a diaphragm fixed at the cylindrical tip end portion of the yoke so as to face each other; and a voice coil fixed to one surface of the diaphragm, wherein the diaphragm is formed, with the central region having rigidity so as to be less flexible compared with an outer circumferential region surrounding the central region, and the voice coil is inserted between the drive magnet and the yoke, and configured to cause the diaphragm to vibrate by a voice signal applied to the both-end lead wire. The both-end lead wire of the voice coil is led out to the outside through the central region of the diaphragm.

7 Claims, 10 Drawing Sheets

(51) Int. Cl.

| | |
|---|---|
| ***H04R 9/06*** | (2006.01) |
| ***H04R 9/08*** | (2006.01) |
| *H04R 7/12* | (2006.01) |
| *H04R 7/14* | (2006.01) |
| *H04R 9/02* | (2006.01) |

(52) U.S. Cl.
CPC ..... *H04R 9/06* (2013.01); *H04R 9/08* (2013.01); *H04R 7/125* (2013.01); *H04R 7/14* (2013.01); *H04R 9/025* (2013.01); *H04R 9/063* (2013.01)

(58) Field of Classification Search
CPC . H04R 9/046; H04R 9/06; H04R 9/08; H04R 2209/024
See application file for complete search history.

(56) References Cited

U.S. PATENT DOCUMENTS

| | | | | |
|---|---|---|---|---|
| 2006/0171555 | A1 | 8/2006 | Brandt | |
| 2008/0044044 | A1 | 2/2008 | Madaffari et al. | |
| 2008/0298629 | A1 | 12/2008 | Huang et al. | |
| 2011/0255715 | A1* | 10/2011 | Doh | B06B 1/045 381/162 |
| 2013/0156237 | A1* | 6/2013 | Kim | H04R 9/06 381/191 |
| 2014/0056446 | A1* | 2/2014 | Li | H04R 1/00 381/162 |

FOREIGN PATENT DOCUMENTS

| | | | |
|---|---|---|---|
| CN | 103167374 | A | 6/2013 |
| CN | 203590436 | U | 5/2014 |
| JP | 5-199586 | A | 8/1993 |
| JP | 11-168799 | A | 6/1999 |
| JP | 2010-283643 | A | 12/2010 |
| WO | 02/052892 | A1 | 7/2002 |
| WO | 2014/061092 | A1 | 4/2014 |

OTHER PUBLICATIONS

International Search Report dated Jul. 28, 2015, issued in counterpart International Application No. PCT/JP2015/062090 (2 pages).
Extended Search Report dated Oct. 5, 2018, issued in counterpart to European Application No. 158898353 (10 pages).
Office Action dated Apr. 2, 2019, issued in CN Application No. 201580078260.3, with partial English translation. (7 pages).

* cited by examiner

ELECTROACOUSTIC TRANSDUCER

TECHNICAL FIELD

The present invention relates to an electroacoustic transducer, and more particularly to a speaker device such as an earphone and a headphone worn on user's ears and head, or a large-sized speaker, and further to improvement of an electroacoustic transducer usable as a microphone.

DESCRIPTION OF RELATED ART

Conventionally, as a speaker device to be worn on the user's ear, for example, as shown in FIG. 9, the following configuration is well-known: one end surface of a cylindrical drive magnet 5 is fixed in a cup-shaped yoke 3 placed in a case body 1, and a thin diaphragm 7 facing the other end surface of the drive magnet 5 with a space provided therebetween is fixed to a tip of the yoke 3, and a cylindrical voice coil 9 fixed to the diaphragm 7 is inserted into an outer circumference of the drive magnet 5 with a small space provided therebetween.

The case body 1 is composed of a funnel shaped base portion 1*a* and a front cover 1*b* covering a tip of the base portion 1*a* (the right side in FIG. 9). A flexible ear tip (earpat, earpiece) 13 is fitted around the outer circumference of a sound tube 11 protruding from the front cover 1*b*.

Reference numeral 15 in FIG. 9 is a cable led to the outside, and there is a knot 15*a* of the cable in the base portion 1*a*.

In this speaker device, a driving unit 17 for vibrating the diaphragm 7 is formed by the drive magnet 5 and the voice coil 9, and by applying a voice signal from the outside to the voice coil 9 using the cable 15, the diaphragm 7 is caused to vibrate and output sound, and the output sound is propagated from the sound tube 11 on the front face of the diaphragm 7 to the outside.

The speaker device as an actual product is configured, for example, in an ear canal insertion type earphone device, and is used in such a way that the case body 1 is inserted into an ear conchal cavity 25 surrounded by a user's tragus 19, antitragus 21, and concha 23, so that the diaphragm 7 approaches the concha 23, and an ear tip 13 is elastically abutted on an inner wall of an ear canal 27 extending from the conchal cavity 25 to an ear drum (not shown).

As an actual product, there is a coaxial type in which a central axis of the sound tube 11 is aligned with a central axis of the diaphragm 7 as shown in FIG. 9 described above, and there is a noncoaxial type in which the central axis of the sound tube 11 is obliquely set with respect to the central axis of the diaphragm 7 although not shown. FIG. 9 shows a state in which the earphone device is worn on the left car.

A known example of the earphone is disclosed in Japanese Patent Laid-Open Publication No. 2010-283643 (Patent Document 1), and a known example of the speaker device is disclosed in Japanese Patent Laid-Open Publication No. 11-168799 (Patent Document 2).

PRIOR ART DOCUMENT

Patent Document

[Patent Document 1] Japanese Patent Laid-Open Publication No. 2010-283643

[Patent Document 2] Japanese Patent Laid-Open Publication No. 11-168799

DISCLOSURE OF THE INVENTION

Problem to be Solved by the Invention

However, as shown in FIG. 10A, the abovementioned speaker device is configured, for example so that a both-end lead wire 9*a* is led to an outside space from one place of a root of the voice coil 9. In this configuration, it is found that when the voice coil 9 is displaced and vibrated by applying a voice signal to the both-end lead wire 9*a*, there is the following effect on a sound reproduction.

That is, in the configuration shown in FIG. 10A, at a lead-out position P1 of the both-end lead wire 9*a* of the voice coil 9 and a diagonal position P2 diagonal thereto, the diaphragm 7 is liable to be more largely displaced at the diagonal position P2 than at the lead-out position P1 of the both-end lead wire 9*a*, mainly due to presence or absence of a load of the both-end lead wire 9*a* added on the diaphragm 7.

It is found that this tends to affect a sound reproduction, and there is a room for improvement in order to reproduce high-quality sound in a wide frequency band.

Further, as shown in FIG. 10B, there is a configuration in which the both-end lead wire 9*a* is led from one position P3 of the voice coil 9 to an outside position P4 of the diaphragm 7, and the both-end lead wire 9*a* is fastened to a circumferential region (corrugation edge part) of the diaphragm 7 up to the outside position P4, using a flexible adhesive agent (not shown). Although not shown, there is also a configuration in which the both-end lead wire is led out from two positions of the voice coil.

Whether the place where the both-end lead wire 9*a* is led out from the voice coil 9 is one place or two places, a node of a rolling motion of the diaphragm 7 is more liable to occur at one point in a case of one place, and on a line connecting two places in a case of two places.

This causes an increase of a distortion factor, or deterioration of a transient response characteristic, and further an abnormal vibration such as buzziness at the time of an excessive input of the voice signal. Therefore, it is also found that there is a room for improvement in order to reproduce high-quality sound in a wide frequency band.

Therefore, a new configuration is found by inventor of the present invention, as a result of earnest study on various configurations in pursuit of further higher quality. Thus, the present invention is completed.

In order to solve the above problem, the present invention is provided, and an object of the present invention is to provide an electroacoustic transducer having a wide frequency band and excellent transient response characteristics, and capable of reproducing high-quality sound particularly in a low frequency range.

Means for Solving the Problem

SUMMARY OF THE INVENTION

In order to solve the above problem, according to a first configuration of the electroacoustic transducer of the present invention, there is provided an electroacoustic transducer, including:

a cylindrical yoke;

a drive magnet placed coaxially with the yoke so as to circumferentially face the yoke, and forming a magnetic circuit between the drive magnet and the cylindrical tip end portion of the yoke;

a thin diaphragm fixed at the cylindrical tip end portion of the yoke so as to face end surfaces of the yoke and the drive magnet with a space provided therebetween and having a central region and an outer circumferential region surrounding the central region, and a voice coil formed into a cylindrical shape with a thin insulating wire wound thereon and fixed to yoke-side one surface of the diaphragm so as to surround the central region, and inserted into a ring-shaped space between the drive magnet and the yoke, and configured to cause the diaphragm to vibrate by a voice signal applied to the both-end lead wire.

wherein the diaphragm is formed, with the central region having rigidity so as to be less flexible compared with the outer circumferential region, and the voice coil has the both-end lead wire led out to the outside through the central region of the diaphragm.

According to the first configuration of the electroacoustic transducer of the present invention, the both-end lead wire extending from the voice coil is directly fastened to the diaphragm at least in the central region.

According to the first configuration of the electroacoustic transducer of the present invention, the both-end lead wire is fastened to a recessed portion formed in the central region of the diaphragm, and led out to the outside.

According to the first configuration of the electroacoustic transducer of the present invention, the both-end lead wire is led out to the outside through a small hole formed on the recessed portion of the diaphragm so as to penetrate therethrough.

According to a second configuration of the electroacoustic transducer of the present invention, a first speaker unit and a second speaker unit are placed so as to be coaxially stacked.

The first speaker unit includes:

a cylindrical first yoke;

a first drive magnet placed coaxially with the first yoke so as to circumferentially face the first yoke, and forming a magnetic circuit between the first drive magnet and the cylindrical tip end portion of the first yoke:

a thin common diaphragm fixed at the cylindrical tip end portion of the first yoke so as to face end surfaces of the first yoke and the first drive magnet with a space provided therebetween and having a central region and an outer circumferential region surrounding the central region; and a first voice coil formed into a cylindrical shape with a thin insulating wire wound thereon and fixed to the first yoke-side one surface of the common diaphragm so as to surround the central region, and inserted into a ring-shaped space between the first drive magnet and the first yoke, and configured to cause the common diaphragm to vibrate by a voice signal applied to the both-end lead wire, wherein the common diaphragm is formed, with the central region having rigidity so as to be less flexible compared with the outer circumferential region, and the first voice coil has the both-end lead wire led out to the outside through the central region of the common diaphragm.

Further, the second speaker unit includes:

the common diaphragm in common;

a cylindrical second yoke placed coaxially with the first yoke, interposing the common diaphragm;

a second drive magnet placed to face the common diaphragm and coaxially with the second yoke so as to circumferentially face the second yoke, and forming a magnetic circuit between the second drive magnet and the cylindrical tip end portion of the second yoke on the common diaphragm side; and a second voice coil formed into a cylindrical shape with a thin insulating wire wound thereon and fixed to the second yoke-side one surface of the common diaphragm so as to surround the central region, and inserted into a ring-shaped space between the second drive magnet and the second yoke, and configured to cause the common diaphragm to vibrate in the same direction as the first voice coil by a voice signal which has a phase opposite to that of the voice signal to the first voice coil and which is applied to the both-end lead wire, wherein the second voice coil has the both-end lead wire led out to the outside through the central region of the common diaphragm.

In addition, according to a third configuration of the electroacoustic transducer of the present invention, the first speaker unit and the second speaker unit are placed so as to be coaxially stacked.

The first speaker unit includes:

a cylindrical first yoke:

a first drive magnet placed coaxially with the first yoke so as to circumferentially face the first yoke, and forming a magnetic circuit between the first drive magnet and the cylindrical tip end portion of the first yoke:

a thin first diaphragm fixed at the cylindrical tip end portion of the first yoke so as to face end surfaces of the first yoke and the first drive magnet with a space provided therebetween and having a first central region and an outer circumferential region surrounding the first central region; and a first voice coil formed into a cylindrical shape with a thin insulating wire wound thereon and fixed to the first yoke-side one surface of the first diaphragm so as to surround the first central region, and inserted into a ring-shaped space between the first drive magnet and the first yoke, so that the first diaphragm is caused to vibrate by a voice signal applied to the both-end lead wire, wherein the first diaphragm is formed, with the central region having rigidity so as to be less flexible compared with the first outer circumferential region, and the first voice coil has the both-end lead wire led out to the outside through the first central region of the first diaphragm.

Further, the second speaker unit includes:

a cylindrical second yoke placed coaxially with the first yoke interposing the first diaphragm;

a second drive magnet placed to face the first diaphragm and coaxially with the second yoke so as to circumferentially face the second yoke, and forming a magnetic circuit between the second drive magnet and the cylindrical tip end portion of the second yoke, a second thin diaphragm placed at the cylindrical tip end portion of the second yoke and fixed so as to face end surfaces of the second yoke the second drive magnet with a space provided therebetween and having a second central region and an outer circumferential region surrounding the second central region; and a second voice coil formed into a cylindrical shape with a thin insulating wire wound thereon and fixed to the second yoke-side one surface of the second diaphragm so as to surround the second central region, and inserted into a ring-shaped space between the second drive magnet and the second yoke, and configured to cause the second diaphragm to vibrate in the same direction as the first diaphragm by a voice signal which has a phase opposite to that of the voice signal applied to the first voice coil and which is applied to the both-end lead wire, wherein the second diaphragm is formed, with the central region having rigidity so as to be less flexible compared with the second outer circumferential region, and the second voice coil has the both-end lead wire led out to the outside through the second central region of the second diaphragm.

According to the second and third configurations of the electroacoustic transducer of the present invention, the both-end lead wire from the first voice coil is directly fastened to the central region of the diaphragm to which at least the first voice coil is fixed, and the both-end lead wire from the second voice coil is directly fastened to the central region of the diaphragm to which at least the second voice coil is fixed.

According to the second and third configurations of the electroacoustic transducer of the present invention, the both-end lead wire from the first voice coil is directly fastened to a recessed portion formed in the central region of the diaphragm to which the first voice coil is fixed and led out to the outside, and the both-end lead wire from the second voice coil is directly fastened to a recessed portion formed in the central region of the diaphragm to which the second voice coil is fixed and led out to the outside.

According to the first to third configurations of the electroacoustic transducer of the present invention, in the central region of the diaphragm, a bent portion for suppressing flexure is formed on the diaphragm itself, or a reinforcing layer is superimposed on the diaphragm, and the central region has a great rigidity so as to be less flexible compared with the outer circumferential region.

Advantage of the Invention

According to the first configuration of the electroacoustic transducer of the present invention, the diaphragm has a central region having a rigidity so as to be less flexible compared with the outer circumferential region, and the both-end lead wire of the voice coil is led to the outside through the central region. Therefore, a rolling motion of the diaphragm is prevented compared with a conventional both-end lead wire lead-out configuration, and a smooth piston motion of the diaphragm is secured. As a result, it is possible to obtain excellent transient response, low distortion rate, and a wide frequency band, and a high-quality sound can be reproduced particularly in a low frequency range.

According to the first configuration of the electroacoustic transducer of the present invention, the both-end lead wire from the voice coil is directly fastened to the diaphragm at least in the central region. Therefore, a reliable holding state of the both-end lead wire is secured, and it is easy to stabilize the characteristics, and manufacturing is facilitated.

According to the first configuration of the electroacoustic transducer of the present invention, the both-end lead wire is fastened to the recessed portion formed in the central region of the diaphragm and led out to the outside. Therefore, it is easy to hold an adhesive agent or the like in the center region, a fastening work of the both-end lead wire is simplified, and a manufacturing efficiency is further improved.

According to the first configuration of the electroacoustic transducer of the present invention, the both-end lead wire is led out to the outside through a small hole formed on the recessed portion of the diaphragm so as to penetrate therethrough. Therefore, the both-end lead wire can be led out from either side of the diaphragm and a lead-out position becomes constant, and it is easy to stabilize and maintain frequency characteristics.

According to the second configuration of the electroacoustic transducer of the present invention, the diaphragm has the central region that exhibits rigidity that is less flexible than the outer circumferential region, and the first and second speaker units are configured so that the both-end lead wires of the first and second voice coils are led out to the outside through the central region of each of the common diaphragms, and the common diaphragms are caused to vibrate in the same direction by the first and second voice coils. Therefore, in a configuration having a common diaphragm and coaxially stacking the first and second speaker units, a wide frequency band and excellent transient response characteristics are exhibited while securing a loud sound output, and a high-quality sound can be reproduced particularly in a low frequency range.

According to the third configuration of the electroacoustic transducer of the present invention, the first and second speaker units have first and second diaphragms having the central region exhibiting rigidity which is less flexible as compared with the outer circumferential region, and the both-end lead wire of the first voice coil for vibrating the first diaphragm is led out to the outside through the first central region of the first diaphragm, and the both-end lead wire of the second voice coil for vibrating the second diaphragm is led out to the outside through the second central region of the second diaphragm, and the first and second diaphragms are vibrated in the same direction by the first and second voice coils. Therefore, in the electroacoustic transducer having the first and second speaker units which are coaxially stacked on each other, a wide frequency band and excellent transient response characteristics are exhibited while securing a loud sound output, and a high-quality sound can be reproduced particularly in a low frequency range.

According to the second and third configurations of the electroacoustic transducer of the present invention, the both-end lead wire from the first voice coil is fastened to the central region of the diaphragm, and the both-end lead wire from the second voice coil is fastened to the central region of the diaphragm. Therefore, in a configuration using the common diaphragm or in a configuration using separate first and second diaphragms, a loud sound output is enabled, the rolling motion of the diaphragm is prevented, and a smooth piston motion can be obtained. As a result, excellent transient response, low distortion rate, and wide frequency band can be obtained.

According to the second and third configurations of the electroacoustic transducer of the present invention, the both-end lead wire from the first voice coil is fastened to the recessed portion formed in the central region of the diaphragm and led out to the outside, and the both-end lead wire from the second voice coil is fastened to the recessed portion formed in the central region of the diaphragm and led out to the outside. Therefore, in a configuration using the separate first and second diaphragms, a loud sound output is enabled, it is easy to hold an adhesive agent or the like in the central region, a fastening work of the both-end lead wire is simplified, and a manufacturing efficiency is further improved.

DETAILED DESCRIPTION OF THE INVENTION

An embodiment of an electroacoustic transducer according to the present invention will be described hereafter, with reference to the drawings, using a speaker device (for example, an earphone device) as an example.

Figure 1:
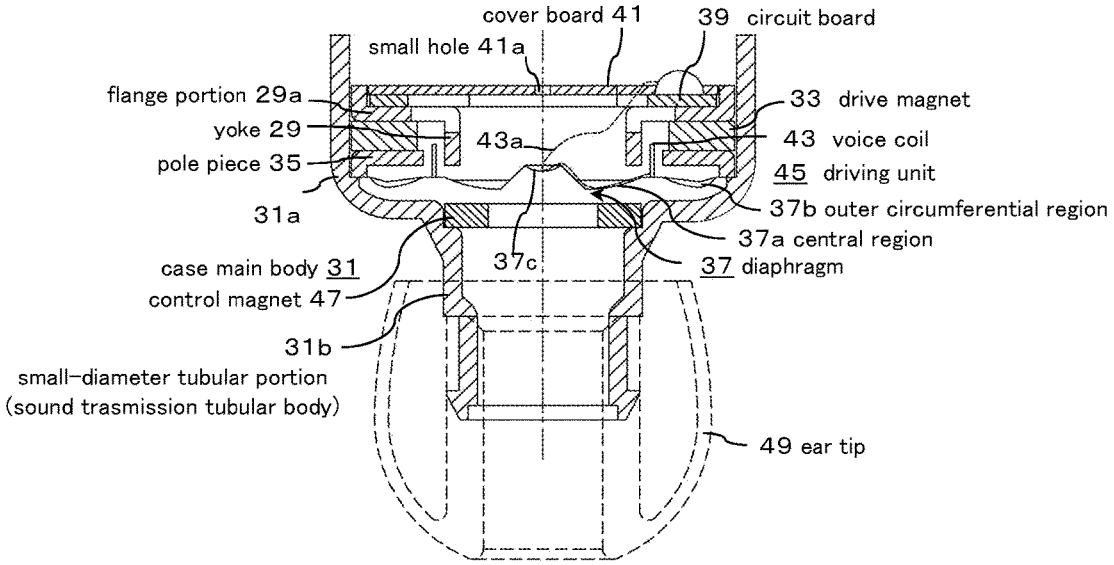
FIG. 1 is a vertical cross-sectional view showing an embodiment of a first configuration of an electroacoustic transducer of the present invention.

FIG. 1 is a vertical cross-sectional view showing an embodiment of a first configuration of an electroacoustic transducer of the present invention.

In FIG. 1, a yoke 29 is formed by molding a magnetic plate material into a cylindrical shape, having a ring-shaped flange portion 29*a* formed by bending an open-end side (upper side in FIG. 1) outward, in which an outer circumferential portion of the flange portion 29*a* is bent so as to rise slightly upward, and is fitted into a case body 31.

On the outer circumference of the yoke 29 body, a cylindrical drive magnet 33 is placed so as to overlap on the flange portion 29*a*, with a space provided between the yoke 29 and the drive magnet 33.

In FIG. 1, a ring-shaped pole piece 35 made of a magnetic material is placed on the lower surface of the drive magnet 33 so as to overlap thereon. In FIG. 1, the inner circumference of the pole piece 35 and the downward tip end portion side of the yoke 29 are circumferentially faced with each other at almost the same level position, with a ring-shaped space provided therebetween.

The pole piece 35 is made of a member for concentrating magnetic flux to thereby obtain high sound quality (hereinafter the same). Such a pole piece 35 can be identified with the drive magnet 33.

The yoke 29, the drive magnet 33, and the pole piece 35 are coaxially fixed and integrally formed using an adhesive agent or the like (not shown), and are fixed to the flange portion 29*a* from below.

A magnetic circuit is formed by the magnetic flux from the yoke 29, between the inner circumference of the pole piece 35 and the tip end portion of the yoke 29 facing the pole piece 35 with a small space provided therebetween.

Figure 2A:
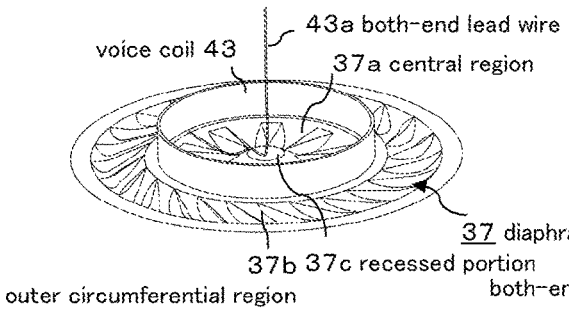
FIGS. 2A and 2B are perspective views of a first configuration of a diaphragm of the electroacoustic transducer of FIG. 1.
Figure 2B:
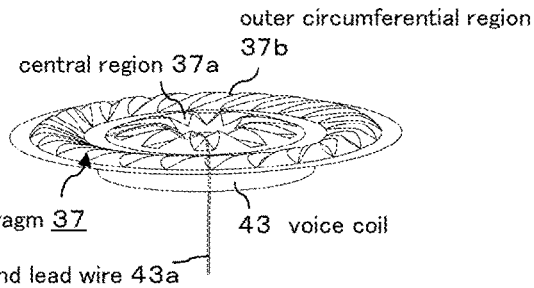

As shown in FIG. 2, the diaphragm 37 is formed into a disc shape and made of a conventionally known thin insulated film material, and has a central region 37*a* which is formed by expanding a relatively wide central part into a slightly a dome-shape, and an outer circumferential region 37*b* surrounding the central region 37*a* in a concentric circular or ring-shaped shape with a narrow width. FIGS. 2A and 2B show the diaphragm 37 being turned upside down respectively.

In the central region 37*a* of the diaphragm 37, a bent portion is formed, which is obtained by bending a film material by giving thereto a rib of a folded shape, or a radial or concentric circular rib, or the like, and the central region 37*a* has rigidity so as to be less flexible. At the center of the central region 37*a*, the recessed portion 37*c* protruding downward in FIG. 1 is formed, and this recessed portion 37*c* also serves as a bent portion to improve the rigidity of the central region 37*a*.

In the outer circumferential region 37*b*, a radial fine concavo-convex strip called a corrugation edge is formed, but the outer circumferential region 37*b* is easily flexible compared with the central region 35*a*. Therefore, flexibility to vibration is increased.

That is, the central region 37*a* has a great rigidity and is less flexible compared with the outer circumferential region 37*b*. It is preferable that the central region 37*a* has a rigidity of about 2 to 5 times greater than the outer circumferential region 37*b*. Nevertheless, it is important that a rigidity range is within a range in which good vibration of the diaphragm 37 including the central region 37*a* is ensured.

Figure 2C:
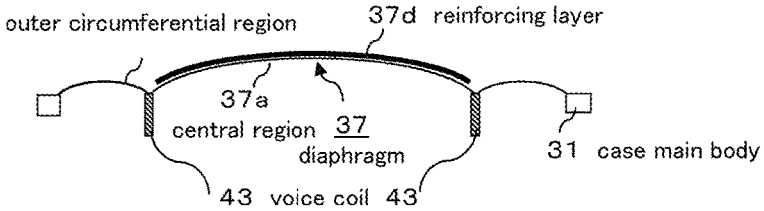
FIG. 2C is a schematic cross-sectional view of the first configuration of the diaphragm of the electroacoustic transducer of FIG. 1.

The diaphragm 37 may be configured as follows: a bending portion that suppresses flexing of the central region 37*a* is formed on the diaphragm 37 itself, and in addition, as shown in FIG. 2C, a reinforcing layer 37*d* such as a separate film board, a coating layer of diamond, ruby or the like, a metal vapor deposition layer of aluminum or titanium or a sputtering layer, is formed on the central region 37*a* so as to overlap thereon. With this configuration as well, it is possible to make the central region 37*a* have a great rigidity so as to be less flexible compared with the outer circumferential region 37*b*.

As shown in FIG. 1, the diaphragm 37 covers the open-end surface (tip end portion) side of the yoke 29 and the pole piece 35 with a space provided therebetween, and an entire outer edge of the outer circumferential region 37*b* is fixed to an outer circumferential edge of the pole piece 35 and supported by the pole piece 35.

A circuit board 39 is fixed to an outer surface (upper surface side in FIG. 1) of the flange portion 29*a* of the yoke 29. A voice signal is supplied to the circuit board 39 from an electronic device (not shown) by a cable (not shown) (see FIG. 9).

Reference numeral 41 in FIG. 1 denotes a cover substrate, and a small hole 41*a*, which is a braking hole for sound quality adjustment, is penetrated through a cover board 41.

On one surface side (upper surface side in FIG. 1) of the diaphragm 37, one end surface side of the cylindrical voice coil 43 is fixed to a ring-shaped boundary between the central region 37*a* and the outer circumferential region 37*b* so as to surround the central region 37*a*.

The voice coil 43 is an integral piece of thin, insulated conductor wire wrapped in a circular cylinder, wherein the both-end lead wire 43*a* is led out to the recessed portion 37*c* formed in the central region 37*a*, and is directly fastened to the diaphragm 37 using an adhesive agent (not shown) applied to the recessed portion 37*c*.

The both-end lead wire 43*a* is partially fastened to the diaphragm 37 in such a manner as slightly touching on the diaphragm 37 at a plurality of locations from a root of the voice coil 43 to the recessed portion 37*c*, for example, at three locations, in the central region 37*a*.

The voice coil 43 is inserted between an outer circumference of the yoke 29, and inner circumferences of the drive magnet 33 and the pole piece 35, with a small space provided between the yoke 29, and the drive magnet 33 and the pole piece 35, and circumferentially faces the outer circumference of the yoke 29 and the inner circumference of the drive magnet 33 with a small space provided therebetween.

The both-end lead wire 43*a* from the voice coil 43 is led out from the recessed portion 37*c* of the diaphragm 37 to the outside, and is connected to the circuit board 39. The both-end lead wire 43*a* is wired in the air with a margin to prevent the stress from being added by the vibration of the diaphragm 37 described later.

The voice coil 43 is displaced by the application of the voice signal to the voice coil 43 via the both-end lead wire 43*a*, so that the diaphragm 37 is vibrated and driven.

That is, a driving unit 45 for vibrating and driving the diaphragm 37 is formed by the yoke 29, the drive magnet 33, and the voice coil 43, to thereby constitute an external magnetic type speaker.

The abovementioned case main body 31 has a large-diameter tubular portion 31*a* into which the yoke 29, the drive magnet 33 and the pole piece 35 are fitted, and a small-diameter tubular portion 31*b* having almost the same size as the yoke 29 continuously from the large-diameter tubular portion 31*a*. The large-diameter tubular portion 31*a* and the small-diameter tubular portion 31*b* are integrally molded from an insulating synthetic resin or the like.

The yoke 29, the drive magnet 33, and the pole piece 35 are integrally fitted into the large-diameter tubular portion 31*a*, and are fixed to the inside of the large-diameter tubular portion 31*a* and supported thereby.

In the case main body 31, a portion which is changed from the large-diameter tubular portion 31*a* to the small-diameter tubular portion 31*b* covers the diaphragm 37 with a space provided therebetween, and a control magnet 47 is fixed to this portion so as to face the yoke 29 interposing the diaphragm 37, and so as to cover the small-diameter tubular portion 31*b*.

The control magnet 47 has a ring plate shape having an outer diameter size substantially equal to that of the yoke 29, and is placed in parallel with the drive magnet 33 or the pole piece 35, and the surface side facing the yoke 29 is magnetized to have the same polarity as that of the yoke 29.

The control magnet 47 suppresses a diffusion of the leak flux from the yoke 29 to the pole piece 35 and compresses the magnetic flux, and has a function of reducing a driving loss of the diaphragm 37 through an increase of a magnetic flux density.

The speaker device having the abovementioned configuration is commercialized as an earphone device, in which a cover or the like (not shown) is put on the outside of the large-diameter tubular portion 31*a* in the case body 31, and a flexible ear tip 49 is fitted to the outer circumference of the small-diameter tubular portion 31*b*. The ear tip is not shown in the second and later configurations described later.

In such a speaker device, the driving unit 45 causes the diaphragm 37 to vibrate and output sound by applying the voice signal to the voice coil 43, and a vibration sound is propagated to the outside through the small-diameter tubular portion 31*b* which serves as a sound tube.

Figure 9:
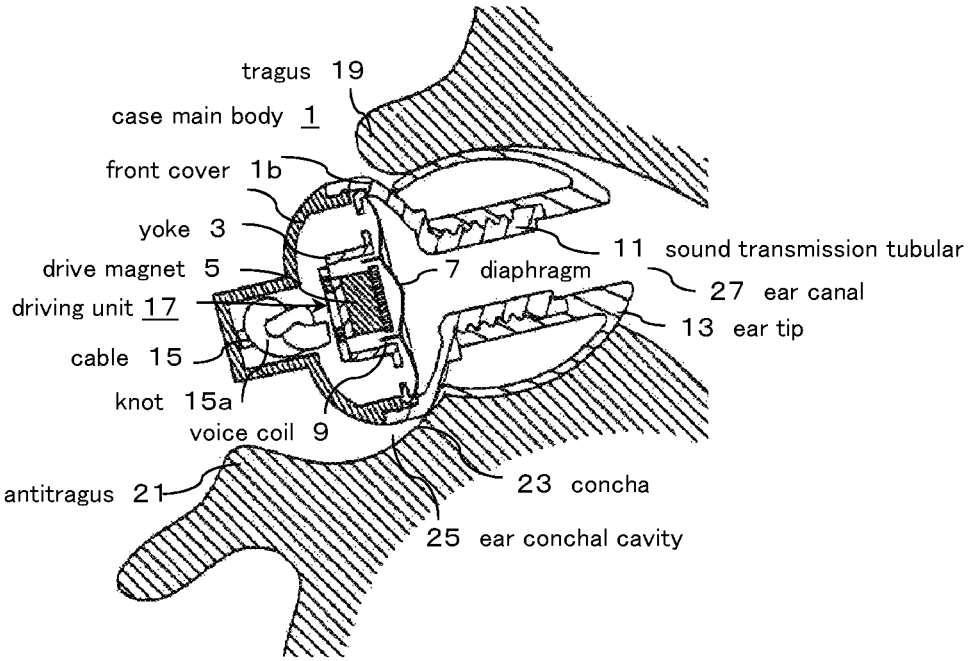
FIG. 9 is a cross-sectional view showing a conventional electroacoustic transducer together with use examples.

Then, as shown in FIG. 9 described above, the speaker device of the present invention is used by wearing it in such way that the case body 31 is housed in the ear conchal cavity 25 surrounded by the tragus 19, the antitragus 21, and the concha 23, and the tip end ear tip 49 is inserted into the ear canal 27.

As shown in FIG. 10, in the first configuration of such a speaker device of the present invention, a lead-out position P5 of the both-end lead wire 43*a* from the voice coil 43, that is, a load position, is the center of the central region 37*a* of the diaphragm 37, and therefore an entire diaphragm 37 is uniformly displaced in a piston mode. Therefore, it is possible to reproduce high-quality sound in a wide frequency band, with excellent transient response waveform, particularly in a low frequency range. Specifically, it is easy to distinguish reproduced sounds of musical instruments and the like.

Further, an operation of the speaker device will be described in detail hereafter.

In the abovementioned speaker device of the present invention, the both-end lead wire 43*a* is led out from the root of the voice coil 43 to the central region 37*a* of the diaphragm 37, and is fixed to the recessed portion 37*c* using an adhesive agent or the like, and is led out from the recessed portion 37*c* by aerial wiring. Therefore, when the diaphragm 37 is in operation, a mechanical load is added on the diaphragm 37 due to an influence of the both-end lead wire 43*a* of the central region 37*a*, for example, due to the mass and stiffness of the both-end lead wire 43*a*.

However, the central region 37*a* inside of the voice coil 43 is vertically vibrated simultaneously with the voice coil 43, but as shown in FIG. 1, a bent portion such as a folded-back portion or a recessed portion 37*c* is formed in the central region 37*a* so as to be strengthened and have rigidity, and the central region 37*a* itself becomes an inflexible region that is not flexible.

Therefore, the load by the both-end lead wire 43*a* of the voice coil 43 is hardly added on the diaphragm 7, by receiving the load at the central part of the central region 37*a* which is an inflexible region. The diaphragm 37 is uniformly displaced as a whole without performing rolling motion like a conventional case, thus contributing to improving the frequency characteristics, transient response characteristics, and the like.

In addition to the reinforcing function, the recessed portion 37*c* also serves as a center marker of the diaphragm 37.

On the other hand, in the conventional speaker device, in order to improve a low frequency response, a vibration amplitude of the diaphragm 37 is increased, and therefore increase of distortion, occurrence of chattering noise, and the like are likely to cause abnormal vibration.

Figure 10A:
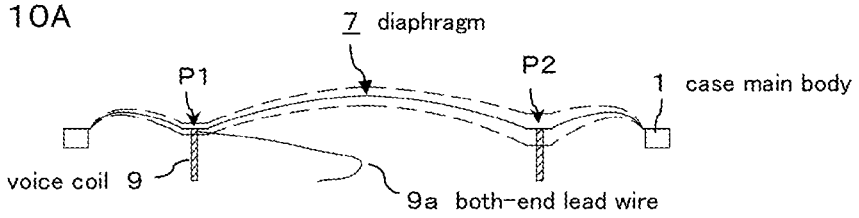
FIGS. 10A through 10C each is a schematic view for explaining an operation of a conventional electroacoustic transducer and the electroacoustic transducer of the present invention.

In the conventional speaker device, as shown in FIG. 10A, the diaphragm 7 is liable to perform an operation called unbalanced rolling due to the load of the both-end lead wire 9*a*. The diaphragm 7 is designed on the premise of this matter. Then, in order to absorb the distortion to some extent at the time of vibration of the diaphragm 7, it has been common that the portion corresponding to the central region 7*a* is formed into a spherical shape so that it is vibrated while flexing to some extent.

Then, in a conventional configuration, when the rigidity of the diaphragm 43 is increased as in the present invention, further distortion occurs in the outer circumferential region 37*b* which is vibrated while flexing, and an abnormal vibration sound etc. is likely to occur.

In the configuration of the present invention, the rolling motion hardly occurs on the diaphragm 37, and therefore distortion such as twisting hardly occurs in the outer circumferential region 37*b*, and the degree of freedom in designing a corrugation edge portion can be much improved compared with the conventional configuration. In addition, since distortion, chattering noise, and the like are less likely to occur, the response in the low frequency range can be controlled relatively freely.

Figure 3:
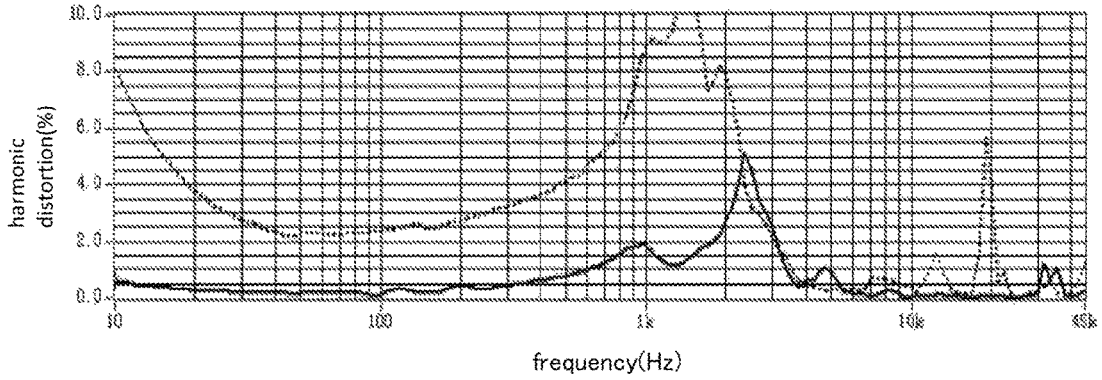
FIG. 3 is a total harmonic distortion characteristic view of the first configuration of the electroacoustic transducer of FIG. 1 and a conventional electroacoustic transducer.

Then, as shown in a full harmonic distortion characteristic shown by the solid line in FIG. 3, the first configuration of the speaker device of the present invention shows the characteristic with less distortion particularly in the low frequency range, and it is found that high-quality sound can be reproduced in a wide frequency band.

On the other hand, as shown in FIG. 10A, in the conventional configuration in which the both-end lead wire 9*a* is led out from the root of the voice coil 9, the total harmonic distortion characteristic in the low frequency range is likely to deteriorate as shown by the frequency characteristic shown by the broken line in FIG. 3.

Figure 10B:
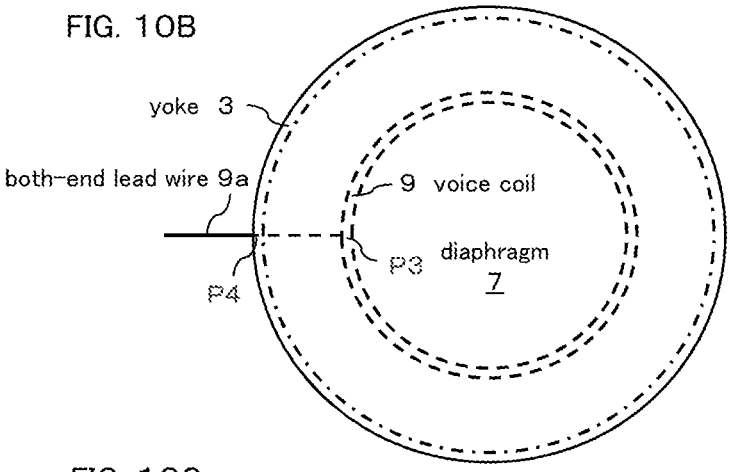
Figure 10C:
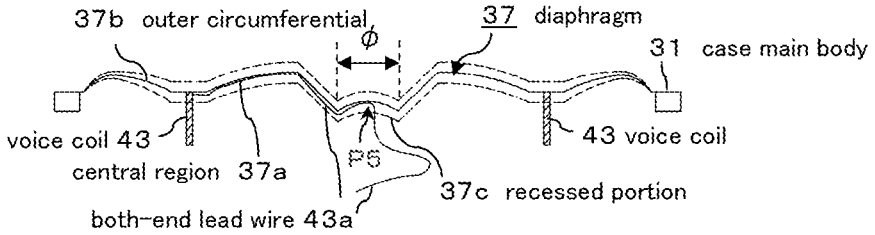

As shown in FIG. 10B, the characteristic such as the configuration in which the both-end lead wire 9*a* of the voice coil 9 is led out to the outer circumferential edge of the diaphragm 7, is also the same as the characteristic shown by the configuration of FIG. 10A.

Figure 4:
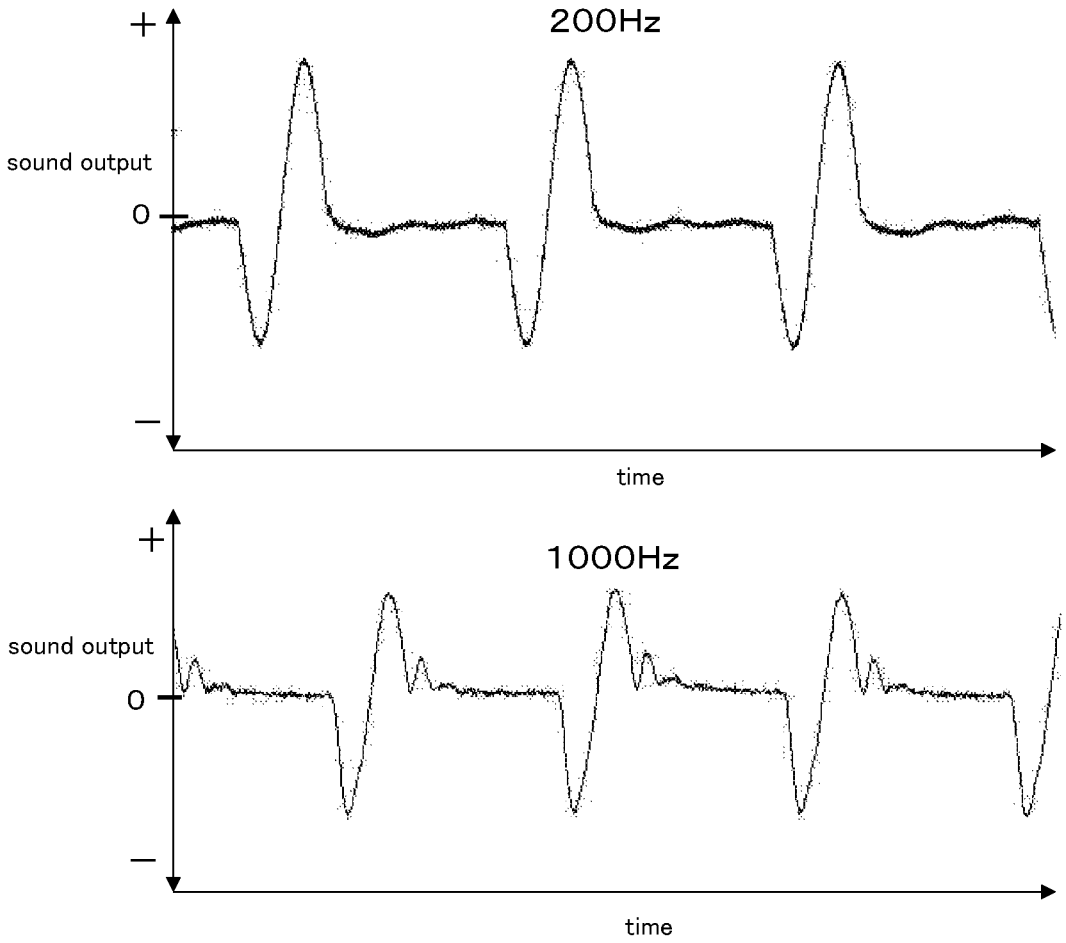
FIG. 4 is a transient response waveform view of a first configuration of the electroacoustic transducer of FIG. 1.

Further, in the first configuration of the speaker device of the present invention, a transient response waveform shown by this configuration is shown in FIG. 4, and it is found that the output signal waveform is less disturbed and the transient response waveform is good when a tone burst signal of 200 Hz and 1000 Hz is applied as the voice signal.

Figure 5:
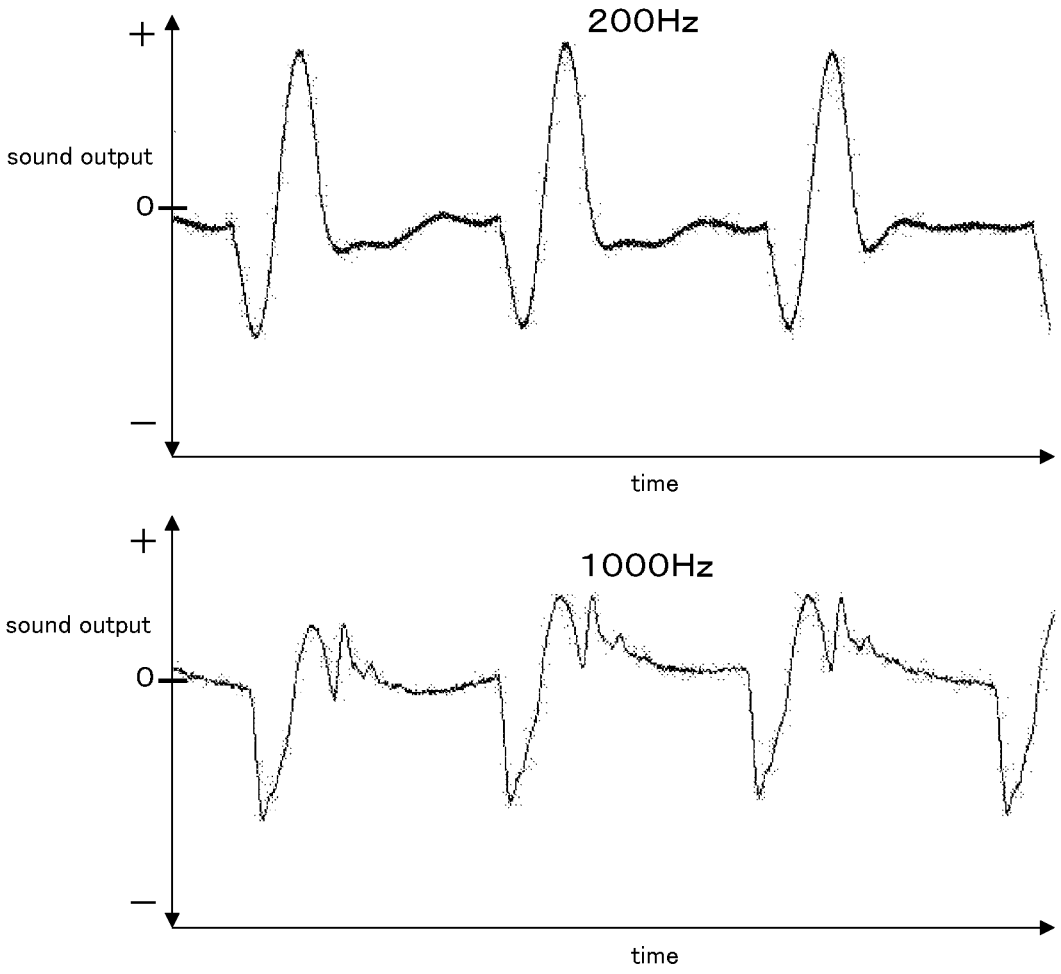
FIG. 5 is a transient response waveform view of a conventional electroacoustic transducer.

On the other hand, in the conventional configuration of FIG. 10A, as shown in FIG. 5, a comparatively large disturbance occurs in the output signal waveform when a 200 Hz and 1000 Hz tone burst signal is applied, and it is found that the transient response waveform of the speaker device of the present invention is improved.

As described above, in the first configuration of the speaker device of the present invention, the both-end lead wire 43*a* from the voice coil 43 is directly fastened to the diaphragm 37 in the central region 37*a* using an adhesive agent or the like. Therefore, the both-end lead wire 43*a* is prevented from rubbing against the diaphragm 37, so that the both-end lead wire 43*a* is less likely to be damaged and the characteristics become stable.

Further, the both-end lead wire 43*a* is led out to the outside through the recessed portion 37*c* formed in the central region 37*a* of the diaphragm 37. Therefore, it is easy to hold the adhesive agent or the like in the central region 37*a*, and a work of fastening the both-end lead wire 43*a* becomes easy. Further, in addition to an advantage that the recessed portion 37*c* functions as a reinforcement and as a marker at the central part as described above, there is also a secondary advantage that manufacturing efficiency is improved.

In the first configuration of the speaker device of the present invention, an object of the present invention can be achieved by fastening the both-end lead wire 43*a* from the voice coil 43 to the diaphragm 37 at least in the central region 37*a*, and it is not absolutely necessary that the both-end lead wire 43*a* is fixed to the diaphragm 37 between the voice coil 43 and the central area 37*a*.

The abovementioned speaker device is configured so that the both-end lead wire 43*a* of the voice coil 43 is led out to the outside from the central part of the central region 37*a*. However, it is not necessary that the lead-out position is strictly located at the center of the central region 37*a*, and for example, as indicated by the symbol "ϕ" in FIG. 10C, the both-end lead wire 43*a* may be led out within a width of the recessed portion 37*c*. Specifically, an object of the present invention can be achieved by leading out the both-end lead wire 43*a* from the center of the central region 37*a* within a range of 10% or less of the outer diameter of a speaker.

A modified example of the first configuration of the speaker device of the present invention will be described next.

Figure 6:
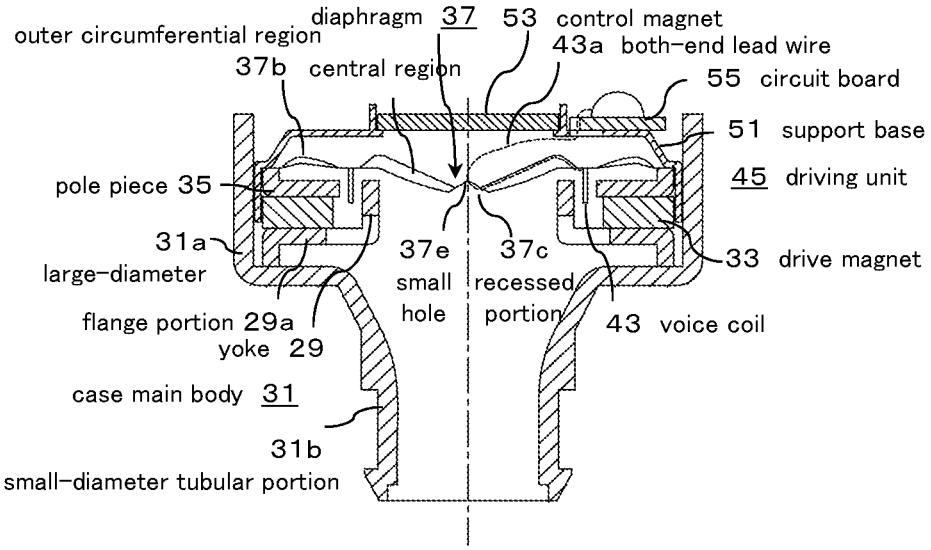
FIG. 6 is a vertical cross-sectional view showing a modified example of the first configuration of the electroacoustic transducer of the present invention.

FIG. 6 is a vertical cross-sectional view showing the modified example of the first configuration.

In FIG. 6, in the speaker configuration of FIG. 1, which includes the yoke 29, the drive magnet 33, the pole piece 35, the diaphragm 37, and the voice coil 43, the diaphragm 37 is directed not to the small-diameter tubular portion 31*b* on the front side but to a back open side of the large-diameter tubular portion 31*a*, and the flange portion 29*a* of the yoke 29 is directed toward the small-diameter tubular portion 31*b*, when the small-diameter tubular portion 31*b* of the case main body 31 is set as the front side (lower side in FIG. 6).

Therefore, arrangements of the main components such as the yoke 29, the case body 31, the drive magnet 33, the pole piece 35, the diaphragm 37, and the voice coil 43, are the reverse of those shown in FIG. 1, but almost the same as those shown in FIG. 1. In the configuration shown in FIG. 6, the same reference numerals are given to portions in common with those of FIG. 1.

In the diaphragm 37 of FIG. 6, the central region 37*a* has a great rigidity so as to be less flexible compared with the outer circumferential region 37*b*. This point is the same as the abovementioned configuration, but the diaphragm 37 of FIG. 6 is shown slightly differently from FIG. 1.

In the configuration of FIG. 6, The circumferential edge portion of the flange portion 29*a* of the yoke 29 is fitted into the case body 31, in contact with a flat portion extending to the small-diameter tubular portion 31*b* from the large-diameter tubular portion 31*a*, and the diaphragm 37 is placed to face the open-end side of the large-diameter tubular portion 31*a*.

The inside of the side wall of the cup-shaped support base 51 is integrally fitted into the outer circumference of the yoke 29, drive magnet 33, pole piece 35, and diaphragm 37 which are integrally formed, so as to cover the diaphragm 37 with a space provided therebetween. The support base 51 is fitted and fixed so that the outside of the side wall is in contact with the inner wall of the large-diameter tubular portion 31*a* of the case main body 31.

In the same way as the abovementioned control magnet 47, the control magnet 53, which is magnetized to have the same polarity as the yoke 29 on the side facing the yoke 29, is fixed to a middle space of the support base 51 so as to face the yoke 29 interposing the diaphragm 37.

A small hole for controlling a sound quality is opened on the support base 51 or the control magnet 53.

On the support base 51, a circuit board 55 similar to the circuit board 39 is fixed to a position near the control magnet 53. The both-end lead wire 43*a* of the voice coil 43 is led out to the side of the support base 51 through the small hole 37*e* formed on the recessed portion 37*c* of the diaphragm 37 and is connected to the circuit board 55.

The other configuration and operation in the modified example of the first configuration shown in FIG. 6 are the same as the abovementioned first configuration shown in FIG. 1, and the obtained characteristics are also similar.

Further, in the modified example of the first configuration, the both-end lead wire 43*a* is led out to the outside through the small hole 37*e* formed on the recessed portion 37*c* of the diaphragm 37. Therefore the both-end lead wire 43*a* can be led out not only from the placement side of the voice coil 43, but also from the opposite side thereto on the diaphragm 37, and the lead-out position is liable to be constant. Therefore, various configurations are acceptable while maintaining a stable wide frequency characteristic.

An embodiment of a second configuration of the speaker device of the present invention will be described next.

Figure 7:
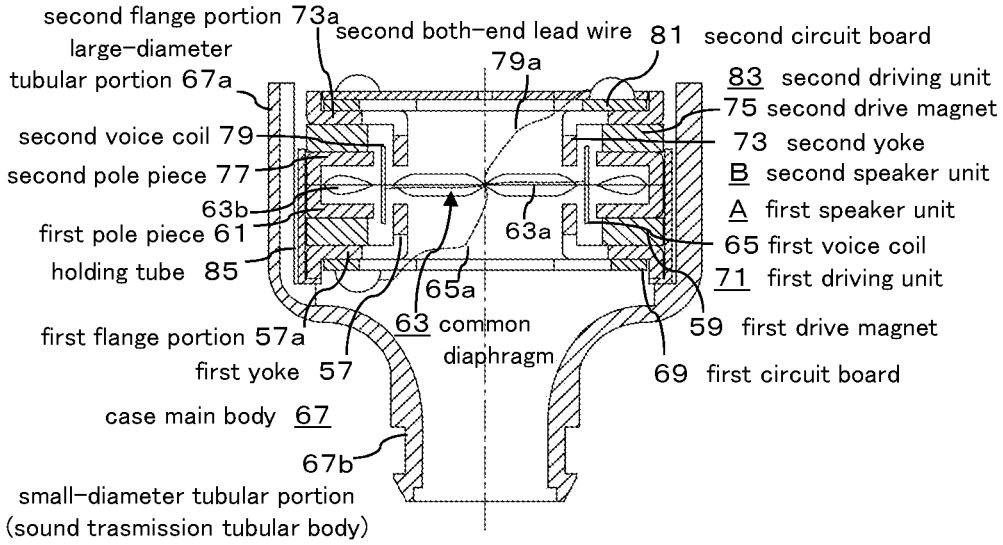
FIG. 7 is a vertical cross-sectional view showing an embodiment of a second configuration of the electroacoustic transducer of the present invention.

FIG. 7 is a vertical cross-sectional view showing the second configuration of the speaker device of the present invention, in which external magnetic type first speaker unit A and second speaker unit B are coaxially placed so as to face each other with the diaphragm in common to each other.

The first speaker unit A has a configuration similar to the speaker unit of FIG. 6, and is formed having a first yoke 57, a first drive magnet 59, a first pole piece 61, a common diaphragm 63, and a first voice coil 65, and is fixed in the case main body 67.

The first yoke 57 is formed by molding a magnetic plate material into a cylindrical shape, having a ring-shaped first flange portion 57*a* formed by bending an open-end side (lower side in FIG. 7) outward, and the outer circumferential portion of the first flange portion 57*a* is slightly bent downward.

On the outer circumference of the yoke 57 body, a cylindrical first drive magnet 59 is placed so as to overlap on the first flange portion 57*a*, with a space provided between the yoke 57 and the drive magnet 59.

On the upper end surface of the first drive magnet 59 in FIG. 7, a ring-shaped first pole piece 61 made of a magnetic material is disposed so as to overlap thereon. In FIG. 7, the inner circumference of the first pole piece 61 and the upward tip end portion side of the first yoke 57 are circumferentially faced with each other at almost the same level position, with a ring-shaped space provided therebetween.

Such a first pole piece 61 can also be identified with the first drive magnet 59.

The first yoke 57, the first drive magnet 59, and the first pole piece 61 are coaxially fixed using an adhesive agent or the like not shown, and are integrally fixed to the first flange portion 57*a*.

A first circuit board 69 is fixed to an outer surface (a lower surface in FIG. 7) of the first flange portion 57*a* of the first yoke 57. A voice signal is supplied to the first circuit board 69 from an electronic device (not shown) by a cable (not shown) (see FIG. 9).

The common diaphragm 63 is formed in the same manner as the abovementioned diaphragm 37, and has a central region 63*a* similar to the central region 37*a* and a ring-shaped outer circumferential region 63*b* surrounding the central region 63*a* in the same manner as the outer circumferential region 37*b*. The common diaphragm 63 is differently shown in the figure from the abovementioned diaphragm 37.

In the common diaphragm 63, the central region 63*a* has a great rigidity so as to be less flexible compared with the outer circumferential region 63*b*. This point is the same as the abovementioned first configuration.

The common diaphragm 63 covers the first pole piece 61 and the tip end portion side of the first yoke 57 with a space provided therebetween, and the entire outer edge of the first outer circumferential region 63*b* is fixed to the outer circumferential edge of the first pole piece 61.

On one surface side (lower surface side in FIG. 7) of the common diaphragm 63, one end surface side of the cylindrical first voice coil 65 similar to the voice coil 43, is fixed at a ring-shaped boundary between the first central region 63*a* and the first outer circumferential region 63*b*, so as to surround the first central region 63*a*.

The first both-end lead wire 65*a* of the first voice coil 65 is led out from the root of the first voice coil 65 to the central region 63*a*, and is fastened thereto using an adhesive agent (not shown).

The first both-end lead wire 65*a* is fastened to the diaphragm 63 using an adhesive agent (not shown), for example, at three places extending to the central region 63*a* on the common diaphragm 63.

The first voice coil 65 is inserted between the outer circumference of the first yoke 57 and the inner circumference of the first drive magnet 59, with a small space provided between the first yoke 57 and the first drive magnet 59, and the outer circumference of the first yoke 57 and the inner circumference of the first drive magnet 59 are faced with each other with a small space provided therebetween, interposing the first voice coil 65.

The first both-end lead wire 65*a* from the first voice coil 65, is led out so as to rise from the center of the central region 63*a* of the common diaphragm 63, and is connected to the first circuit board 69 through the space of the first circuit board 69.

The first voice coil 65 is displaced by the application of the voice signal to the first voice coil 65 via the first both-end lead wire 65*a*, and the common diaphragm 63 is caused to vibrate.

That is, a first driving unit 71 for vibrating the common diaphragm 63 is formed by the first yoke 57, the first drive magnet 59, and the first voice coil 65, to thereby constitute an external magnetic type first speaker unit A.

The second speaker unit B is formed having the second yoke 73, the second drive magnet 75, the second pole piece 77, the second voice coil 79, and the common diaphragm 63 described above, and is integrally overlapped on the first speaker unit A, and is fixed in the case main body 67.

The second yoke 73 is formed by molding a magnetic plate material into a cylindrical shape, having a ring-shaped second flange portion 73*a* formed by bending an open-end side (upper side in FIG. 7) outward, and an outer circumferential portion of the second flange portion 73*a* is bent so as to rise slightly upward.

On the outer circumference of the second yoke 73, a cylindrical second drive magnet 75 is placed so as to overlap on the second flange portion 73*a*, with a space provided between the second yoke 73 and the second drive magnet 75.

A ring-shaped second pole piece 77 made of a magnetic material is placed on the lower surface of the second drive magnet 75 in FIG. 7 so as to overlap thereon. In FIG. 7, the inner circumference of the pole piece 77 and the downward tip end portion side of the second yoke 73 are circumferentially faced with each other at almost the same level position, with a ring-shaped space provided therebetween.

The second pole piece 77 can also be identified with the second drive magnet 75.

The second yoke 73, the second drive magnet 75, and the second pole piece 77 are coaxially fixed using an adhesive agent or the like not shown, and are integrally fixed to the second flange portion 73*a*.

Further, a magnetic circuit is formed by the magnetic flux from the second yoke 73, between the inner circumference of the second pole piece 77 and the tip end portion of the second yoke 73 facing the first pole piece 77 with a small space provided therebetween.

A second circuit board 81 is fixed to the outer surface (upper surface side in FIG. 7) of the second flange portion 73*a* of the second yoke 73, and a voice signal is supplied to the second circuit board 81 from an electronic device (not shown) by a cable (not shown) (see FIG. 9).

The common diaphragm 63 covers the tip end portion side of the second pole piece 77 and the second yoke 73 with a space provided therebetween, and the entire circumferential edge portion of the outer circumference region 63*b* is supported by the outer circumferential edges of the first and second pole pieces 61 and 77 so as to be interposed therebetween.

On the other surface side (upper surface side in FIG. 7) of the common diaphragm 63, the abovementioned second voice coil 79 is fixed so as to surround the central region 63*a*.

The second both-end lead wire 79*a* of second voice coil 79 is extended from the root of the second voice coil 79 to the first central region 63*a*, and is fastened thereto using an adhesive agent (not shown).

The second both-end lead wire 79*a* is fastened to the common diaphragm 63 using an adhesive agent (not shown), for example, at three places extending to the central region 63*a* on the common diaphragm 63.

The second voice coil 79 is inserted between the outer circumference of the second yoke 73 and the inner circumference of the second drive magnet 75, with a small space provided between the second yoke 73 and the second drive magnet 75, and the outer circumference of the second yoke 73 and the inner circumference of the second drive magnet 75 are faced with each other with a small space provided therebetween, interposing the second voice coil 79.

The second both-end lead wire 79*a* from the second voice coil 79, is led out so as to rise from the center of the central region 63*a* of the common diaphragm 63, and is connected to the second circuit board 81.

The voice signal which has a phase opposite to that of the first voice coil 65, is transmitted to the second voice coil 79 via the second both-end lead wire 79*a*, the second voice coil 79 is displaced in the same direction as the first voice coil 65, and the common diaphragm 63 is vibrated.

Wiring (not shown) of the voice signal to the first speaker unit A is led out to an upper part of FIG. 7 through a notch portion which is formed by vertically cutting a part of an inside of the large-diameter tubular portion 67*a*.

A second driving unit 83 for vibrating the common diaphragm 63 is formed by the second yoke 73, the second driving magnet 75 and the second voice coil 79, to thereby constitute an external magnetic type second speaker unit B.

The first and second speaker units A and B are integrally fitted into the abovementioned cylindrical holding tube 85, and are fixed in the case main body 67.

The other configuration and operation of the second configuration of the speaker unit of the present invention are the same as the abovementioned configurations of FIG. 1 or 6.

In the second configuration, the external magnetic type first and second speaker units A and B having the common diaphragm 63 are integrally formed. Therefore, due to the abovementioned favorable operation of the common diaphragm 63 in the first and second speaker units A and B, it is possible to reproduce high-quality sound in a wide frequency band, particularly in a low frequency range, while making good use of the same frequency characteristics.

In addition, in the second configuration, the first and second voice coils 65 and 79 are displaced in the same direction to thereby largely displace the common diaphragm 63. Therefore, a loud sound can be reproduced.

An embodiment of a third configuration of the speaker device of the present invention will be described next.

Figure 8:
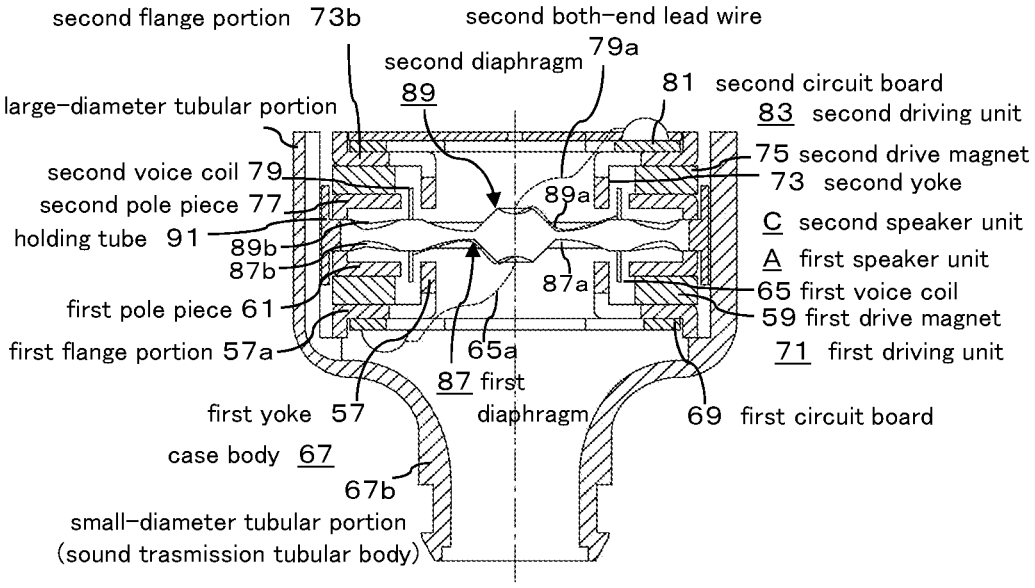
FIG. 8 is a vertical cross-sectional view showing an embodiment of a third configuration of the electroacoustic transducer of the present invention.

FIG. 8 is a vertical cross-sectional view showing a third configuration of the speaker device of the present invention, having the first speaker unit A having the second configuration of the speaker device of FIG. 7 described above, and a second speaker unit C which is similar to the second speaker unit B, in which the first speaker unit A and the second speaker unit C have first and second diaphragms 87 and 89 respectively.

That is, the first diaphragm 87 has a first central region 87*a* and a first outer circumferential region 87*b* in the same manner as the common diaphragm 63, and an entire circumferential edge portion is fixed to an upper open-end of the first pole piece 61 in FIG. 8. The abovementioned first voice coil 65 is fixed to the first diaphragm 87.

The second diaphragm 89 has a second central region 89*a* and a second outer circumferential region 89*b* in the same manner as the common diaphragm 61 and the first diaphragm 87, and the entire circumferential edge portion of the second diaphragm 89 is fixed to a lower open-end of the second pole piece 77 in FIG. 8, with a small space provided between the first and second diaphragm 87 and 89. The abovementioned second voice coil 79 is fixed to the second diaphragm 89 at a position overlapping on the first voice coil 65.

The first and second central regions 87*a* and 89*a* of the first and second diaphragms 87 and 89 are formed in the same manner as the abovementioned central region 37*a* of the diaphragm 37, and the first and second outer circumferential regions 87*b* and 89*b* are also formed in the same manner as the abovementioned outer circumferential region 37*b* of the diaphragm 37.

The space between the first and second diaphragms 87 and 89 is kept acoustically airtight, but it is not necessary that the diaphragm 87 is completely airtight.

Reference numeral 91 in FIG. 8 is a holding tube for connecting and holding the first and second pole pieces 61 and 77 by fitting them, to thereby connect the external magnetic type first speaker unit A and second speaker unit B.

The holding tube 91 is fitted into the large-diameter tubular portion 67*a* of the case main body 67, and the first and second speaker units A and C are held in the case main body 67.

The other configuration and operation of the first and second speaker units A and C are almost the same as the second configuration of the speaker device of FIG. 7.

In the third configuration, favorable operations of the first and second diaphragms 87 and 89 in the first and second speaker units A and C are secured, and in addition, the space between the first and second diaphragms 87 and 89 is maintained in an airtight state, and the first and second diaphragms 87 and 89 are displaced in the same direction in such a manner as in the configuration of FIG. 7. Therefore, with this configuration, a loud sound output can be obtained in a state of satisfactorily maintaining the frequency characteristic, by two first and second speaker units A and C which are capable of reproducing high-quality sound in a wide frequency band, particularly in a low frequency range.

In addition, when the first speaker unit A or the second speaker unit C is placed as a simple body, and when a high input signal is transmitted, the operations of the first and second diaphragms 87, 89 do not show symmetrical vibrations in an upper (protruding) direction and in a lower (recessing) direction due to the configuration of the speaker and the shape of the diaphragm, and generally, distortion easily occurs from one side of the vibration and it is difficult for the vibrations of the first and second diaphragms 87, 89 to become symmetrical.

However, in the third configuration of the present invention, the first and second diaphragms 87 and 89 of the first and second speaker units A and C placed to face each other in a reverse direction are vibrated at the same time in the same direction with the same vibration width as described above. Therefore, the distortion is compensated for each other, the vibrations of the first and second diaphragms 87 and 89 are likely to be symmetrical, and the distortion is reduced.

Further, in the abovementioned second and third configurations of the present invention, the following configurations are also acceptable: the both-end lead wires 65*a* and 79*a* from the first and second voice coils 65 and 79 are fastened at least to the common diaphragm 63 or the central regions 63*a*, 87*a*, 89*a* of the first and second diaphragms 87 and 89; or the both-end lead wires 65*a* and 79*a* are led out to the outside through the recessed portion (not indicated by signs and numerals in FIG. 7 and FIG. 8) formed in the central regions 63*a*. 87*a*, and 89*a*. With these configurations as well, the same effect as the first configuration and the like can be obtained.

In the speaker device of the present invention, when two speaker units A to C are placed, the both-end lead wire 65*a* from the first voice coil 65 is directly fastened to the central regions 63*a* and 87*a* of the diaphragms 63 and 87 to which at least the first voice coil 65 is fixed, and the both-end lead wire 79*a* from the second voice coil 79 is directly fastened to the central regions 63*a* and 89*a* of the diaphragms 63 and 89 to which at least the second voice coil 79 is fixed.

Further, in the speaker device of the present invention, the first and second speaker units A to C are not necessarily required to be placed in the same shape or coaxially. However, by forming them in the same shape or placing them coaxially, the common speaker unit can be used for the first and second speaker units A to C, then cost can be reduced, miniaturization becomes easy, and desired characteristics can be easily obtained.

Further, in the speaker device of the present invention, both the yoke and the drive magnet can have either an external magnetic type or an internal magnetic type configuration located on the inner side or the outer side, and it may be configured so that the drive magnet is placed coaxially with the yoke so as to circumferentially face the yoke, and the magnetic circuit is formed between the cylindrical tip end portion of the yoke and the drive magnet.

Further, in the speaker device of the present invention, the sound tube formed by the small-diameter tubular portion 67*b* of the case main bodies 31 and 67 protrudes along the central axes of the case main bodies (small-diameter tubular portions) 31 and 67. In addition to this configuration, it is also acceptable that the sound tube is protruded obliquely with respect to the central axes.

The electroacoustic transducer of the present invention can be widely used as a speaker device such as a headphone, a large-sized speaker, and further, a microphone.

DESCRIPTION OF SIGNS AND NUMERALS

1, 31, 67 case main body
1*a* base portion
1*b* front cover
3 yoke
5, 33 drive magnet
7, 37 diaphragm
9, 43 voice coil
11 sound tube
13, 49 ear tip (earpat, earpiece)
15 cable
15*a* knot
17, 45 driving unit
19 tragus
21 antitragus
23 concha
25 ear conchal cavity
27 ear canal
29 yoke
29*a* flange portion
31*a* large-diameter tubular portion
31*b* small-diameter tubular portion
35 pole piece
37*a*, 63*a* central region
37*b*, 63*b* outer circumferential region
37*c* recessed portion (bent portion)
37*d* reinforcing layer
37*e* small hole
39, 55 circuit board
41 cover board
41*a* small hole
43*a* both-end lead wire
47, 53 control magnet
51 support base
27 first yoke
57*a* first flange portion
59 first drive magnet
61 first pole piece
63 common diaphragm
65 first voice coil
65*a* first both-end lead wire
69 first circuit board
71 first driving unit
73 second yoke
73*a* second flange portion
75 second drive magnet
77 second pole piece
79 second voice coil
81 second circuit board
83 second driving unit
85, 91 holding tube
87 first diaphragm
87*a* first central region
87*b* first outer circumferential region
89 second diaphragm
89*a* second central region
89*b* second outer circumferential region
A first speaker unit
B, C second speaker unit
P1, P2, P3, P4, P5 lead-out position

The invention claimed is:

1. An electroacoustic transducer, comprising:

a cylindrical yoke;

a cylindrical drive magnet placed coaxially with the yoke so as to circumferentially face the yoke;

a ring-shaped magnetic pole piece placed coaxially with the yoke so as to circumferentially face the yoke, and forming a magnetic circuit between the drive magnet and the cylindrical tip end portion of the yoke;

a thin diaphragm fixed to an outer circumferential edge portion of the pole piece so as to face the yoke and the pole piece with a space provided therebetween and having a central region and an outer circumferential region surrounding the central region;

a voice coil formed into a cylindrical shape with a thin insulating wire wound thereon and fixed to yoke-side one surface of the diaphragm so as to surround the central region, and inserted into a ring-shaped space between the drive magnet and the pole piece, and the yoke, and configured to cause the diaphragm to vibrate by a voice signal applied to the both-end lead wire, wherein the diaphragm is formed, with the central region having rigidity so as to be less flexible compared with the outer circumferential region, and the voice coil has the both-end lead wire led out to the outside through the central region of the diaphragm; and wherein the both-end lead wire from the voice coil is directly fastened to the diaphragm at least in a central part of the central region.

2. The electroacoustic transducer according to claim 1, wherein the both-end lead wire is fastened to a recessed portion formed in the central part of the central region of the diaphragm and led out to the outside.

3. The electroacoustic transducer according to claim 2, wherein the both-end lead wire is led out to the outside through a small hole formed on the recessed portion of the diaphragm so as to penetrate therethrough.

4. An electroacoustic transducer comprising a first speaker unit and a second speaker unit placed so as to be coaxially stacked, wherein the first speaker unit comprises:

a cylindrical first yoke;

a first cylindrical drive magnet placed coaxially with the first yoke so as to circumferentially face the first yoke;

a ring-shaped first magnetic pole piece placed coaxially with the first yoke so as to circumferentially face the first yoke and so as to overlap on the first drive magnet, and forming a magnetic circuit between the first drive magnet and the cylindrical tip end portion of the first yoke;

a thin common diaphragm fixed to an outer circumferential edge portion of the first pole piece at the cylindrical tip end portion of the first yoke so as to face the first yoke and the first pole piece with a space provided therebetween, and having a central region and an outer circumferential region surrounding the central region; and a first voice coil formed into a cylindrical shape with a thin insulating wire wound thereon and fixed to the first yoke-side one surface of the common diaphragm so as to surround the central region, and inserted into a ring-shaped space between the first drive magnet and the first pole piece, and the first yoke, and configured to cause the common diaphragm to vibrate by a voice signal applied to the both-end lead wire, wherein the common diaphragm is formed, with the central region having rigidity so as to be less flexible compared with the outer circumferential region, and the first voice coil has the both-end lead wire led out to the outside through the central region of the common diaphragm, and the second speaker unit comprises:

the common diaphragm in common;

a cylindrical second yoke placed coaxially with the first yoke, interposing the common diaphragm;

a cylindrical second drive magnet placed coaxially with the second yoke so as to circumferentially face the second yoke;

a ring-shaped second magnetic pole piece placed coaxially with the second yoke so as to circumferentially face the second yoke and so as to overlap on the drive magnet, and forming a magnetic circuit between the drive magnet and the cylindrical tip end portion of the second yoke;

a second voice coil formed into a cylindrical shape with a thin insulating wire wound thereon and fixed to the second yoke-side one surface of the common diaphragm so as to surround the first central region, and inserted into a ring-shaped space between the second drive magnet and the second pole piece, and the second yoke, and configured to cause the common diaphragm to vibrate in the same direction as the first voice coil by a voice signal which has a phase opposite to that of the voice signal to the first voice coil and which is applied to the both-end lead wire, wherein the second voice coil has the both-end lead wire led out to the outside through the central region of the common diaphragm; and wherein the both-end lead wire from the first voice coil is directly fastened to a central part of the central region of the diaphragm to which at least the first voice coil is fixed, and the both-end lead wire from the second voice coil is directly fastened to the central part of the central region of the diaphragm to which at least the second voice coil is fixed.

5. The electroacoustic transducer according to claim 4, wherein the both-end lead wire from the first voice coil is directly fastened to a recessed portion formed in the central part of the central region of the diaphragm to which the first voice coil is fixed and led out to the outside, and the both-end lead wire from the second voice coil is directly fastened to a recessed portion formed in the central part of the central region of the diaphragm to which the second voice coil is fixed and led out to the outside.

6. An electroacoustic transducer comprising a first speaker unit and a second speaker unit placed so as to be coaxially stacked, wherein the first speaker unit comprises:

a cylindrical first yoke;

a cylindrical first drive magnet placed coaxially with the first yoke so as to circumferentially face the first yoke;

a ring-shaped first magnetic pole piece placed coaxially with the first yoke so as to circumferentially face the first yoke and so as to overlap on the first drive magnet, and forming a magnetic circuit between the drive magnet and the cylindrical tip end portion of the first yoke;

a first thin diaphragm fixed to an outer circumferential edge portion of the first pole piece at the cylindrical tip end portion of the first yoke so as to face the first yoke and the first pole piece with a space provided therebetween, and having a first central region and a second-outer circumferential region surrounding the first central region; and a first voice coil formed into a cylindrical shape with a thin insulating wire wound thereon and fixed to the first yoke-side one surface of the first diaphragm so as to surround the first central region, and inserted into a ring-shaped space between the first drive magnet and the first pole piece, and the first yoke, so that the first diaphragm is caused to vibrate by a voice signal applied to the both-end lead wire, wherein the first diaphragm is formed, with the central region having rigidity so as to be less flexible compared with the first outer circumferential region, and the first voice coil has the both-end lead wire led out to the outside through the first central region of the first diaphragm, and the second speaker unit comprises:

a cylindrical second yoke placed coaxially with the first yoke interposing the first diaphragm;

a cylindrical second drive magnet placed coaxially with the second yoke so as to circumferentially face the second yoke;

a ring-shaped second magnetic pole piece placed coaxially with the second yoke so as to circumferentially face the second yoke and so as to overlap on the second drive magnet, and forming a magnetic circuit between the second drive magnet and the cylindrical tip end portion of the second yoke;

a second thin diaphragm placed to face the second yoke and the second pole piece with a space provided therebetween, and fixed to an outer circumferential edge portion of the second pole piece, and having a second central region and a second outer circumferential region surrounding the second central region;

a second voice coil formed into a cylindrical shape with a thin insulating wire wound thereon and fixed to the second yoke-side one surface of the second diaphragm so as to surround the second central region, and inserted into a ring-shaped space between the second drive magnet and the second pole piece, and the second yoke, and configured to cause the second diaphragm to vibrate in the same direction as the first diaphragm by a voice signal which has a phase opposite to that of the voice signal applied to the first voice coil and which is applied to the both-end lead wire, wherein the second diaphragm is formed, with the central region having rigidity so as to be less flexible compared with the second outer circumferential region, and the second voice coil has the both-end lead wire led out to the outside through the second central region of the second diaphragm; and wherein the both-end lead wire from the first voice coil is directly fastened to a central part of the central region of the diaphragm to which at least the first voice coil is fixed, and the both-end lead wire from the second voice coil is directly fastened to the central part of the central region of the diaphragm to which at least the second voice coil is fixed.

7. The electroacoustic transducer according to claim 6, wherein the both-end lead wire from the first voice coil is directly fastened to a recessed portion formed in the central part of the central region of the diaphragm to which the first voice coil is fixed and led out to the outside, and the both-end lead wire from the second voice coil is directly fastened to a recessed portion formed in the central part of the central region of the diaphragm to which the second voice coil is fixed and led out to the outside.

* * * * *